US012329205B2

(12) United States Patent
Lawson et al.

(10) Patent No.: US 12,329,205 B2
(45) Date of Patent: Jun. 17, 2025

(54) MOUTHPIECE ASSEMBLY FOR AN INHALATION DEVICE INCLUDING A REPLACEABLE SUBSTRATE COMPONENT, AND A REPLACEABLE SUBSTRATE COMPONENT THEREFOR

(71) Applicant: VENTUS MEDICAL Limited, Liverpool (GB)

(72) Inventors: David Lawson, Liverpool (GB); Gethin Griffith, Liverpool (GB); Mark Dignum, Liverpool (GB)

(73) Assignee: Ventus Medical Limited, Liverpool (GB)

( * ) Notice: Subject to any disclaimer, the term of this patent is extended or adjusted under 35 U.S.C. 154(b) by 1092 days.

(21) Appl. No.: 16/961,040

(22) PCT Filed: Jan. 10, 2019

(86) PCT No.: PCT/EP2019/050515
§ 371 (c)(1),
(2) Date: Jul. 9, 2020

(87) PCT Pub. No.: WO2019/137982
PCT Pub. Date: Jul. 18, 2019

(65) Prior Publication Data

US 2020/0352242 A1 Nov. 12, 2020

(30) Foreign Application Priority Data

Nov. 1, 2018 (GB) ..... 1800500

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/46* (2020.01); *A24F 42/60* (2020.01)

(58) Field of Classification Search
CPC ..... A24F 40/10; A24F 40/20; A24F 47/00; A24F 47/42; A61M 15/06; A24D 3/18
See application file for complete search history.

(56) References Cited

U.S. PATENT DOCUMENTS 7,726,320 B2 * 6/2010 Robinson ..... H05B 3/42 131/194
9,943,114 B2 * 4/2018 Batista ..... A24F 40/70
(Continued)

FOREIGN PATENT DOCUMENTS

WO 2015100361 A1 7/2015
WO 2016005530 A1 1/2016
(Continued)

OTHER PUBLICATIONS

European Patent Office, International Preliminary Examining Authority, International Preliminary Report on Patentability, Int'l App. No. PCT/EP2019/050515, Apr. 24, 2020.
(Continued)

*Primary Examiner* — Russell E Sparks
(74) *Attorney, Agent, or Firm* — John H. Choi & Associates

(57) ABSTRACT

A mouthpiece assembly for an inhalation device including a replaceable substrate component and a replaceable substrate component therefor. The mouthpiece assembly includes a mouthpiece which is essentially a hollow tube within which fluid flow can occur along a substantially longitudinal axis thereof. Within the mouthpiece, a cavity region is formed which is adapted to receive and locate the substantially planar elongated substrate component, such that it interacts with the fluid flow when occurring. The substrate component
(Continued)

includes a substrate which can be excited sufficiently to cause aerosolization, and the substrate is fixedly mounted within the substrate component in an orientation and location whereby a channel formation or a conduit of the substrate component at least partially coincides with the cavity region, and thus the surface of the substrate in that cavity region is exposed to, and may be entrained within, whatever fluid may be flowing in that channel or conduit.

17 Claims, 9 Drawing Sheets

(51) Int. Cl.

| | |
|---|---|
| ***A24F 40/42*** | (2020.01) |
| ***A24F 40/46*** | (2020.01) |
| ***A24F 42/60*** | (2020.01) |

(56) References Cited

U.S. PATENT DOCUMENTS

| | | | | |
|---|---|---|---|---|
| 9,986,767 | B2 | 6/2018 | Batista | |
| 10,045,567 | B2 | 8/2018 | Monsees | |
| 10,058,124 | B2 | 8/2018 | Monsees | |
| 10,264,823 | B2 | 4/2019 | Monsees | |
| 10,500,354 | B2 * | 12/2019 | Newberry | A24F 40/53 |
| 10,602,776 | B2 * | 3/2020 | Batista | A24B 15/167 |
| 10,701,975 | B2 | 7/2020 | Bowen | |
| 10,729,181 | B2 | 8/2020 | Zinovik | |
| 10,750,780 | B1 | 8/2020 | Zinovik | |
| 11,019,850 | B2 * | 6/2021 | Sebastian | A61M 15/06 |
| 11,224,254 | B2 | 1/2022 | Zinovik | |
| 11,229,235 | B2 * | 1/2022 | Saygili | A24F 40/485 |
| 11,229,758 | B2 | 1/2022 | Davidson | |
| 11,632,978 | B2 * | 4/2023 | Rojo-Calderon | A24C 5/01 131/111 |
| 11,752,283 | B2 | 9/2023 | Atkins | |
| 11,839,706 | B2 * | 12/2023 | Zuber | A61M 15/0036 |
| 11,864,590 | B2 | 1/2024 | Zinovik | |
| 2015/0208729 | A1 | 7/2015 | Monsees | |
| 2017/0119959 | A1 * | 5/2017 | Zuber | A24F 40/46 |
| 2017/0143041 | A1 | 5/2017 | Batista et al. | |
| 2017/0144827 | A1 | 5/2017 | Batista | |
| 2017/0181472 | A1 | 6/2017 | Batista | |
| 2018/0064174 | A1 | 3/2018 | Monsees | |
| 2018/0070643 | A1 | 3/2018 | Monsees | |
| 2018/0070647 | A1 | 3/2018 | Monsees | |
| 2018/0092405 | A1 | 4/2018 | Monsees | |
| 2018/0092406 | A1 | 4/2018 | Monsees | |
| 2018/0168225 | A1 | 6/2018 | Zinovik | |
| 2019/0001087 | A1 | 1/2019 | Davidson | |
| 2020/0260787 | A1 | 8/2020 | Zinovik | |
| 2021/0045441 | A1 | 2/2021 | Zinovik | |
| 2021/0352967 | A1 | 11/2021 | Zinovik | |
| 2022/0143338 | A1 | 5/2022 | Davidson | |
| 2024/0033448 | A1 * | 2/2024 | Zuber | A24F 40/46 |

FOREIGN PATENT DOCUMENTS

| | | | | |
|---|---|---|---|---|
| WO | 2016005531 | A1 | 1/2016 | |
| WO | 2016005600 | A1 | 1/2016 | |
| WO | 201615216 | A1 | 10/2016 | |
| WO | WO-2016156216 | A1 * | 10/2016 | A24B 15/167 |
| WO | 2017005471 | A1 | 1/2017 | |
| WO | 2017122196 | A1 | 7/2017 | |
| WO | WO-2018177826 | A1 * | 10/2018 | A24F 47/008 |
| WO | 2018197513 | A1 | 11/2018 | |

OTHER PUBLICATIONS

European Patent Office, International Search Report, Int'l App. No. PCT/EP2019/050515, Apr. 8, 2019.

* cited by examiner

MOUTHPIECE ASSEMBLY FOR AN INHALATION DEVICE INCLUDING A REPLACEABLE SUBSTRATE COMPONENT, AND A REPLACEABLE SUBSTRATE COMPONENT THEREFOR

CROSS-REFERENCE TO RELATED APPLICATIONS

This application is a national stage application of PCT/EP2019/050515, filed on Jan. 10, 2019, which claims priority to GB1800500.9, filed on Jan. 11, 2018.

FIELD OF INVENTION

The present invention relates to a mouthpiece assembly for an inhalation device including a replaceable substrate component, and a replaceable substrate component therefor. More specifically, the invention relates to a mouthpiece assembly for an inhalation device which is adapted to receive a replaceable substrate component capable of receiving a source of energy by means of which the substrate itself, or an energizeable element applied thereto or formed therewith, may be excited, such excitation being sufficient to cause an amount of a suitable formulation or a constituent composition therein and having been deposited on a surface of said substrate component, to be at least partially aerosolized, atomized, vaporised, gasefied or otherwise promoted into the ambient atmosphere surrounding it within the mouthpiece. Yet further specifically, the invention relates to a mouthpiece assembly including such a substrate component and which is provided with at least air inlet and outlet regions and within which, by means of suction pressure most commonly applied by a user's mouth at the outlet region, air is caused to flow from the inlet region towards the outlet region through at least one conduit defined within said mouthpiece assembly and/or said substrate component and at least some part of which is in communication with ambient air above that portion of the substrate component on which the amount of formulation has been deposited and which may thus be entrained into said air flow.

Most particularly, the present invention is concerned with what have become known as Electronic Nicotine Delivery Systems (ENDS, herein being both singular and plural as required by context), and in this regard the formulation which is deposited on the substrate component will most typically be a nicotine-containing formulation. However, the skilled reader will understand that this need not be the case, and that the present invention is not limited by the specific formulation deposited on the substrate component, except that it should be aerosolizable at least to some extent upon receiving excitation energy. In the following description, the excitation energy is exclusively electrical, and the energizeable element forming part of the substrate component is an electrically resistive heating element, but again of course this need not be the case, and the skilled reader is to understand that the present invention is not particularly concerned with either the manner of excitation or with the excitation energy per se, and is more concerned with the specific configuration of both the substrate component and the mouthpiece assembly into which it may be replaceably inserted, and how the two cooperate, particularly in the context of air flow through the mouthpiece assembly, to deliver an inhalable mixture of air and aerosolized formulation (or some constituent or derivative thereof). For the avoidance of doubt, the skilled reader is also to understand that any use herein of the term "aerosolize" or any cognate expression is to be interpreted as encompassing any physical process whereby the formulation, or any constituent composition or derivative thereof, is promoted into the surrounding atmosphere, in any phase, i.e. as a gas, a liquid, or a solid, or any phase intermediate thereof, and the meaning of such term or terms could therefore extend any one or more of: atomization, vaporization, gasification, nebulisation, to name but a few.

BACKGROUND TO THE INVENTION

ENDS have been in widespread use now for some years, and although there has been and continues to be little concrete scientific evidence as to how harmful they are to human health, in particular human lungs, it is largely beyond doubt that the use of any ENDS is significantly less harmful than the smoking of combustible tobacco products, such as cigarettes, cigars, cigarillos, pipes, and hand rolling tobacco. The primary reason for the comparative health benefit of ENDS as compared to conventional combustible tobacco products is that the nicotine-containing smoke inhaled by users of the latter contains significant levels of a multitude carcinogens and other toxicant products of combustion (some estimate a few thousand different compositions including many 10*s* of known carcinogens), whereas the so-called vapour inhaled by users of ENDS consists primarily only of nicotine, and one or more of: glycerol, polyethylene glycol (PEG), vegetable glycerol (VG), and/or propylene glycol (PG), and derivatives of these compounds, together with natural and/or synthetic flavouring compositions often added to the liquid formulations utilised in ENDS.

Of course, in the case of both ENDS and combustible tobacco products, the chemically active substance is nicotine ($C_{10}H_{14}N_2$), a potent parasympathomimetic stimulant and alkaloid. In essence, nicotine is a drug and like many drugs, it is highly addictive to humans. In sufficient concentrations, nicotine is also highly toxic to humans, and although nicotine only constitutes approximately 0.6-3.0% of the dry weight of tobacco depending on strain, variety and processing techniques, mere ingestion of only one or two cigarettes, in which there might be as much as 50 mg of nicotine and possibly more, can cause quite serious toxic reactions. Those skilled in the art will immediately understand therefore that the dose of nicotine administered by an ENDS is of critical importance—in general, the dose must be sufficient to satisfy the physiological cravings experienced by users addicted to nicotine, but (arguably) less than that which is typically delivered by a corresponding combustible tobacco product in a similar time scale so that the ENDS can be effective, at least partially, in reducing an addict's dependency on the drug and thus function as a smoking cessation aid.

The majority of currently commonly available ENDS are so-called wick-and-coil devices wherein an electrical heating coil is disposed adjacent, around, within or otherwise proximate a moisture absorbent wick such that a nicotine-containing liquid extant within the wick is heated sufficiently rapidly and to a sufficient degree to cause at least some of that liquid and/or one or more of its constituents to be aerosolized from the wick into the surrounding air in a gaseous or quasi-gaseous phase. The wick-and-coil arrangement may take many different forms, but most commonly both said components will be located within a cartridge or reservoir (a so-called "cartomizer", such term being a conflation of the words "cartridge" and "atomizer") which also contains the nicotine-containing liquid which has been or is to be drawn into the wick. Of course, in order for the coil to be heated, a source of electrical power is required, and in this regard, often the most dominant component in any modern ENDS is the rechargeable battery which may be either an integral part of the device as a whole, or (more commonly) a removable and/or detachable component thereof, but in any event, the cartomizer, and thus the heating coil is electrically connected to the battery and a simple switch is provided in a convenient location on the device so that the user can selectively apply and remove electrical current to and from the heating coil and essentially activate the device. An example prior art cartomizer is depicted in FIG. 1 hereof, and is described more fully below in the specific description hereof.

Although modern ENDS function relatively satisfactorily, a number of inherent disadvantages prevail. Firstly, the absorbent usually fibrous material wicks currently used are inherently deficient in that they cannot achieve completely uniform wicking of the nicotine-containing liquid which in turn results in a rather unpredictable and uneven aerosolization of the absorbed liquid along the length of the wick. In short, there will always exist comparatively drier and wetter regions of the wick, and liquid in those regions will thus be aerosolised to a greater or lesser extent. Furthermore, the heating coils themselves are rather crude and rudimentary, and although some of the more modern ENDS devices include control circuitry which allows for a reduced current to be supplied to the heating coil for a brief period (<1 s) prior to full activation of the heating element so that the coil can be pre-heated to some extent before then supplying a much larger current to the coil to heat it to the required extent for aerosolization to occur, the aerosolization itself is still a largely uncontrolled and certainly highly variable process, particularly in terms of the constituents of the aerosol and the particular phases (gas, liquid, solid or any intermediate thereof) in which such constituents may be present in said aerosol. When it is considered that the boiling points of common carrier chemicals of which modern so-called "e-liquids" are primarily constituted are in the range of 180-290 deg. C., (PEG, with apprx. 4000-6000 mol. weight, boils at 240-260 deg. C., glycerol boils at around 290 deg. C., propylene glycol at around 188 deg. C.), the skilled reader will understand that if a wick-and-coil ENDS is to function at all, then the primary requirement is that the heating coil be sufficiently responsive and capable of rising to that temperature practically instantaneously, or at least in the short time (e.g. less than 1-2 s) it takes a user to bring the device to his lips immediately prior to using it for a single inhalation. In the instance where an e-liquid contains a pharmaceutically or pharmacologically active substance such as nicotine, the crude and rudimentary nature of the wick and coil arrangement precludes dosing consistency between any two successive activations because there is very little if any precision as regards the dose of nicotine in any single activation (i.e. aerosolization).

In the case of nicotine in particular, the actual quantity of nicotine present in an inhaled aerosol is of critical importance, firstly and most obviously because that amount directly represents the amount of the drug being administered to the human per inhalation, and secondly and more subtly, the amount of nicotine present in the aerosol is directly correlated to the tolerability of the aerosol to be inhaled. In brief, the tolerability of an inhaled aerosol is a rather qualitative indication of the extent to which that aerosol, or more precisely the nicotine within it, aggravates the mucosal and buccal receptors at the entrance of and within the throat. Although tolerability is also a rather subjective phenomenon, the skilled reader will nevertheless understand that non-smokers are generally far less tolerant to the inhalation of both smoke from a conventional tobacco product and the aerosols produced by modern ENDS, and their most common initial reaction is to cough as the pulmonary system instinctively attempts to interrupt and effectively reverse and reject the inhalation. The so-called throat "hit" or "dig" is well known to smokers of conventional tobacco products, and indeed is often cited as being one of the more physically and physiologically addictive aspects of smoking, and it is therefore (arguably) a somewhat desirable aspect of smoking cessation aids such as ENDS.

A further and rather less well known aspect of tolerability is that the abovementioned receptors become progressively de-sensitised with each successive inhalation in a typical set (usually about 6-8) of multiple inhalations which are undertaken in a relatively short time period (e.g. 5 min.) when a user smokes either a conventional tobacco product such as a cigarette, or the aerosols produced by ENDS. Furthermore, it is known that the sensitivity of said receptors recovers after a user undertakes all the inhalations within such a set and undertakes no further inhalation for a period of about 30-45 mins. Aside from one or two ENDS devices that provide a coil pre-heating function (during which in any event there is by definition no erosolization), the remainder operate in simple binary fashion in that they are either "on", during which time the coil is electrically activated and an aerosol is being produced (provided of course that the wick is soaked with appropriate liquid), or "off". Thus not only is there little or no control over the amount of nicotine present in any single aerosol produced, there can be significant inconsistencies in the amount of nicotine present between successive aerosolizations. Therefore, the first inhalation in any set of inhalations may seem particularly harsh in the throat of a user, whereas subsequent inhalations may be comparatively mild or become progressively so, in some cases to the extent that the user barely notices any difference between the inhalation of the aerosol and an inhalation of plain air.

It is thus a first object of the invention to provide a modified mouthpiece assembly including a substrate component which at least partially addresses such issues.

Through extensive experimental analysis and research, applicants herefor have realised that the wick-and-coil heaters currently forming an integral and irreplaceable permanent part of practically all modern ENDS might usefully be replaced with a disposable, interchangeable resistive heating element applied to or integrally formed as part of a substrate component which can be pre-dosed with an accurately measured amount of a nicotine-containing formulation. This approach is quite radical as regards conventional ENDS design, but does offer a number of important advantages, in particular as regards the dosing precision of nicotine which can be achieved. For example, in conventional ENDS, typical e-liquids contain only relatively low concentrations of nicotine (e.g. 6-20 mg/ml), and the vast majority of the heat energy generated by the rudimentary wick-and-coil heaters during activation is devoted to aerosolising a relatively very large volume of the carrier compound, e.g. PG and or VG. As the skilled reader will understand, this is inhaled in its entirety and subsequently exhaled as a large visible plume of aerosol. As mentioned above, although inhaling plumes of aerosols consisting of only relatively few chemicals will inevitably be less detrimental to a user's health than inhaling the many thousands of chemicals, some being known carcinogens, present in the smoke from a conventional tobacco product, it remains largely unknown whether frequently and repeatedly inhaling the glycerol-based and/or glycol-based aerosols produced by ENDS and the molecular nicotine suspended or otherwise contained therein is prejudicial to a user's health. Applicants believe it is reasonable to assume that the inhalation of such aerosols cannot actually be beneficial (except from the point of view of being less harmful than conventional tobacco products), and therefore it is inherently desirable to reduce the overall quantity of aerosol inhaled in any single inhalation. Thus by providing a pre-dosed disposable substrate component instead of a cartomizer, it is possible to drastically reduce the volumetric quantity of carrier compound (e.g. from the 1 ml or so that may be soaked throughout the wick of common ENDS to the order of a few 10 s or 100 s of μl present in one or two globules applied to the substrate), provided of course that the concentration of nicotine is correspondingly increased and the heat delivered to those globules is such that sufficient aerosolization of the formulation and the nicotine within it still occurs, and that the concentration of nicotine within the now much smaller volume of aerosol remains essentially the same, i.e. enough to sate a user's craving for nicotine over a complete set of inhalations. If the volume of nicotine-containing formulation applied to the substrate, the nicotine concentration therein, the heat applied to the formulation during each of the activations of the ENDS device as a user performs a set of inhalations, and the airflows over and around the substrate component are all carefully selected, then it is possible for practically all the nicotine within the formulation, and possibly also all of the formulation itself, to be aerosolised after a user has completed a set of 6-8 inhalations, and the substrate component can simply be removed from the mouthpiece and replaced with a new one.

This invention is particularly concerned with the airflows over and around the substrate component, and it is thus a further object of this invention to provide a mouthpiece assembly for an ENDS which not only provides a degree of air resistance, but which also has the benefit of at least partially improving the tolerability of the aerosols produced by the ENDS, particularly when the volume of aerosol produced thereby during any single activation is relatively small compared the voluminous plumes produced by wick-and-coil ENDS and which thus more effectively mask molecular nicotine present therein.

SUMMARY OF THE INVENTION

According to the present invention there is provided a mouthpiece assembly for an inhalation device, and a substrate component for use as part of such a mouthpiece assembly as prescribed in claims hereof.

Thus, by providing a substrate component with suitable channel formations or interior conduits which both coincide with and expose a relevant region of a surface of a substrate which forms part of the substrate component, fluid can be caused to flow directly over a formulation being aerosolised. Furthermore, by ensuring that either or both of the openings and the cross-sectional dimensions of the conduits, whether integral within the substrate component or formed as a result of the cooperation of the substrate component with a suitable interior surface of the mouthpiece, said conduits can simultaneously act as a means of providing a resistance to such fluid flow such that there is a requirement for a user to exert a suction pressure similar to that applied by smokers of conventional tobacco products so that utilising the mouthpiece of the present invention is, physically at least, very similar to smoking a conventional tobacco product.

In most preferred embodiments, the mouthpiece and the substrate component are separate and separable entities in that the substrate component is replaceably insertable and removable from within the mouthpiece. However, in certain embodiments it is envisaged that the substrate component may be integrally formed with the mouthpiece such that the mouthpiece assembly is essentially of unitary construction. In this latter case, it is envisaged that the entire mouthpiece assembly would be discarded and replaced after use, and the description below provided as regards the replaceable nature of the substrate component should be considered as applying equally to a mouthpiece assembly within which a substrate component is integrally formed.

Preferably, the substrate component is provided with two channel formations or interior conduits, such being preferably linear and parallel in configuration and orientation.

Preferably, the substantially planar surface of the substrate component and the corresponding interior surface of the mouthpiece cooperate together to direct any and all of any fluid flow occurring within the mouthpiece component into the at least one conduit, as defined entirely interiorly within said substrate component, or as defined by both the said at least one channel formation and a corresponding interior surface of the said mouthpiece. In an alternative embodiment, the mouthpiece is provided interiorly with at least one secondary conduit which acts as a fluid bypass in that any fluid flow within the mouthpiece, although initially unitary in that the fluid flow into the mouthpiece through the inlet thereof is a single fluid flow, thereafter it divides into in at least two discreet parts, a first active part which is constrained to flow into the conduit provided in, or partially defined by, the substrate component and thus entrain any formulation on the substrate of the substrate component at that time being aerosolised, and a second bypass part which is separate and distinct from the first part and segregated from it for a majority of travel within the mouthpiece. Most preferably, said first active and second bypass parts of the fluid flow within the mouthpiece are reunited within the mouthpiece, and most preferably in a dedicated mixing chamber thereof such that the two parts are partially if not completely mixed with one another prior to the exit of the combined fluid flow through the outlet of said mouthpiece. In preferred embodiments, the mouthpiece is provided with one or more interior baffle formations to further aid mixing of either or both of a fluid in which an aerosol has been entrained and primary and secondary bypass fluid flows occurring within the mouthpiece. Preferably the baffle formations are provided in one or more of: any secondary conduit provided within the mouthpiece, within the mixing chamber itself, or within that part of the mouthpiece between the mixing chamber and the mouthpiece outlet.

Thus by providing this type of bypass arrangement, the overall tolerability of an inhaled aerosol can be improved due to the facts that (a) the predetermined volume to be inhaled can be diluted to a required extent, depending on the cross-sectional area of the secondary bypass conduit within the mouthpiece component, and (b) the bypass fluid can be completely and fully mixed with the fluid flow in which aerosol has been entrained prior to the exit of the combined fluid flow from the outlet of the mouthpiece, and therefore the fluid exiting the mouthpiece will be substantially devoid of any localised concentrations (or absences) of aerosol.

In a modified embodiment, the mouthpiece component is provided with at least one further air inlet in the form of an aperture provided through and disposed in a side wall of said mouthpiece, said aperture being disposed between said first inlet and said outlet and being in fluid communication with both, an interior surface of said side wall being one of those surfaces which constrains fluid flow interiorly and longitudinally axially of the device such that the initial direction of travel of air passing through said aperture is substantially perpendicular to the direction of fluid flow within the mouthpiece from the inlet to the outlet. Thus by providing an essentially secondary and lateral air inlet, further fluid mixing of the relevant flows within the mouthpiece can occur, provided of course that the one or more secondary apertures are provided in suitable locations axially of the said mouthpiece, for instance more proximate the primary inlet than the outlet (most preferably when such apertures define openings of one or more secondary bypass conduits within the mouthpiece), or alternatively, more proximate the outlet of the mouthpiece (when such apertures define a secondary opening and fluid inlet into a mixing chamber provided within the mouthpiece essentially downstream of the channel formations or conduits provided in the substrate component).

Of course, while it is possible to provide the mouthpiece with fluid flow bypass means, it is equally possible, either separately or in conjunction, to provide the substrate component with similar fluid flow bypass and fluid mixing means, and thus in a further preferred embodiment, the substrate component is elongate and the channel formations or conduits provided therein are substantially aligned with the longitudinal axis thereof, and one or more secondary channel formations or interior conduits is provided (the former most preferably cooperating with a corresponding interior surface of the mouthpiece such that together they define a conduit through which fluid can be constrained to flow), said secondary channel formations or interior conduits having entrances which are separate from the entrances of the primary channel formations or conduits, and being either entirely separate therefrom in that said secondary channel formations or conduits are provided with their own discrete and separate exits, or ultimately joining with the primary channel formations or conduits in that the exits of said secondary channel formations or conduits coincide are provided within a top, bottom or side wall of said primary channel formations or conduits and such that there is a confluence of the fluid flows occurring within each of the primary and secondary channel formations or conduits.

In different preferred embodiments, the confluence of fluid flowing in the primary and secondary channel formations or conduits of the substrate component occurs at a position axially of the substrate component which is one of: upstream of the substrate region at which aerosolization of the formulation is occurring, substantially coincidental with that substrate region, and downstream of that region.

In the preferred embodiment wherein the secondary channel formations or conduits provided in the substrate component are entirely separate from the primary channel formations or conduits, the confluence of the fluid flows occurring at any time within the conduits partially or completely defined thereby occurs after both such flows have emerged from said conduits, that is downstream of the substrate component, and within a mixing chamber of the mouthpiece.

Preferably, the entrances of the secondary channel formations or conduits of the substrate component coincide with corresponding fluid inlet apertures provided in the mouthpiece. Most preferably, both the apertures provided in the mouthpiece component and the secondary channel formations or conduits are lateral in that, the said apertures and the entrances of the said secondary channel formations or conduits are provided in side walls of the respective components in which they are provided, such that, initially at least, the direction of the fluid flowing into said secondary channel formations or conduits is substantially perpendicular to the direction of the fluid flow in the primary channel formations or conduits, when such is occurring.

In a most preferred embodiment, one or more interior surfaces of said mouthpiece is provided with a plurality of formations which together at least partially define a cavity region adapted to receive the substrate component. Most preferably, one of the plurality formations at least partially defines an end wall of said cavity region most remote from the mouthpiece air inlet and against which one end of the substrate component abuts when completely received within said cavity region thus ensuring the correct axial position thereof within said mouthpiece. Preferably, at least one of the formations defining the cavity region is internally cantilevered within the mouthpiece, said cantilever being biased slightly into the cavity region when no substrate component is present therein such that when a substrate component is inserted into the said cavity region, the cantilevered formation is deflected outwardly of the cavity region by the front edge of the substrate component and maintained in such deflected condition by the substantially planar surface thereof, said cantilevered formation resiliently and frictionally acting on said substrate component planar surface and thus retaining it in place within the mouthpiece. Thus, by providing such a cantilevered formation within the mouthpiece, the frictional engagement between the substantially planar surface of the substrate component and (at least) the biased free end of said cantilevered formation is sufficient to prevent axial displacement of the substrate component within the cavity region, and also the downward resilient force applied by said cantilevered formation also prevents the substrate component from chattering up and down within the said cavity region.

Preferably the inhalation device is an ENDS.

In a further aspect of the invention, there is provided a substrate component for a mouthpiece assembly for an inhalation device, said substrate component comprising an essentially planar substrate to one side of which has been applied an amount of an aerosolizable formulation on or proximate a region of said substrate which can be excited when said substrate is supplied with a sufficient and appropriate excitation energy, said substrate component further comprising a cover having substantially planar upper and lower surfaces, said substrate being fixedly mounted beneath said cover with said one side being most proximate the lower surface of said cover, characterised in that at least one opening is provided in the cover throughout the depth thereof in a location which at least partially coincides with said region of said substrate and whereby said region of said substrate is exposed to ambient atmosphere through said opening such that any formulation extant on the surface of the substrate and being aerosolized while excitation energy is being supplied is promoted into that fluid instantly present within said opening immediately about the formulation being aerosolized.

Preferably the opening provided in the cover is in the form of an elongate slot. Preferably the elongate slot is chamfered at either end and in opposing manner to facilitate fluid flow downwardly into and upwardly out of said slot.

In a yet further aspect of the invention there is provided a substrate component for a mouthpiece assembly for an inhalation device, said substrate component comprising an essentially planar substrate to one side of which has been applied an amount of an aerosolizable formulation on or proximate a region of said substrate which can be excited when said substrate is supplied with a sufficient and appropriate excitation energy, said substrate component further comprising a cover having substantially planar upper and lower surfaces, said substrate being fixedly mounted beneath said cover with said one side being most proximate the lower surface of said cover, characterised in that at least a pair of discrete spaced apart openings is provided in the upper surface of the cover, and an elongate channel is provided in the lower surface thereof extending between said pair of openings such that, together with the said one side of said substrate, at least one interior conduit is defined within the substrate extending between the spaced apart openings which act as respectively an inlet and an outlet for fluid flow, said elongate channel effectively constraining such fluid flow and being at least partially coincident with said region of said substrate and whereby said region of said substrate is exposed to ambient atmosphere present in the conduit so defined such that any formulation extant on the surface of the substrate and being aerosolized while excitation energy is being supplied is promoted into that fluid instantly present within said opening immediately about the formulation being aerosolized.

Preferably, at least 2 pairs of discrete spaced apart openings is provided in the upper surface of the cover, and a pair of laterally spaced elongate channels is provided in the lower surface thereof extending between said pair of openings such that, together with the said one side of said substrate, at least one interior conduit is defined within the substrate extending between the spaced apart openings which act as respectively a pair of inlets and a pair of outlets for fluid flow, and wherein the at least a pair of spaced apart regions of the substrate have had an amount of a formulation applied thereto, each of said elongate channels being at least partially coincident with a respective one of said regions whereby each of said regions of said substrate is exposed to ambient atmosphere present in the pair of conduits so defined.

In further aspects of the present invention, there is also provided a substrate component, and a mouthpiece.

A specific embodiment of the invention is now described by way of example and with reference to the accompanying drawings wherein:

DETAILED DESCRIPTION

Figure 1:
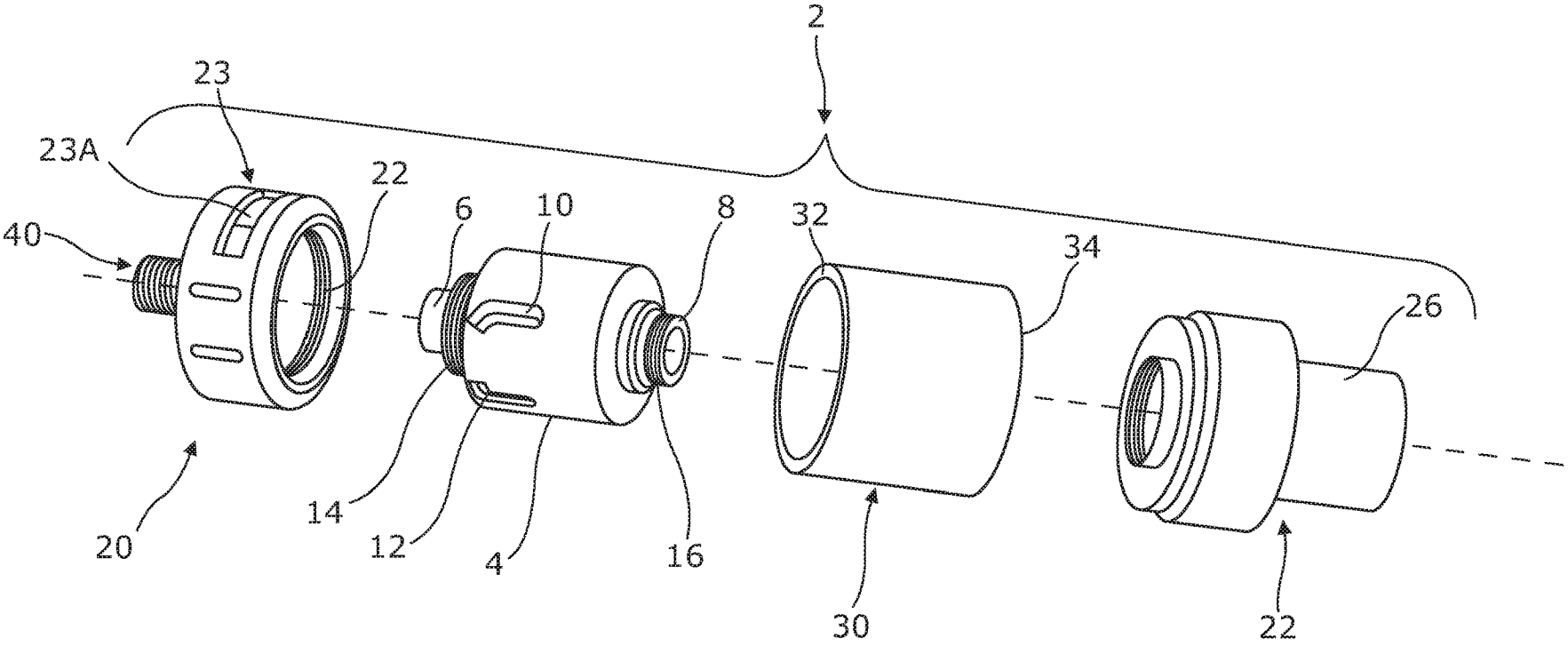
Fig. 1 (Prior Art)
FIG. 1 shows an exploded perspective view of a prior art cartomizer for a modern, conventional ENDS.

Referring firstly to FIG. 1, there is shown an exploded perspective view of a cartomizer assembly 2 of the prior art, in particular a cartomizer forming part of a prior art ENDS sold under the trade name "SMOK®" and manufactured by Shenzhen IVPS Technology Co. Ltd. Cartomizer 2 consists of a cylindrical cartridge 4 within which a cylindrical wick and coil arrangement (not shown) is centrally disposed and defines a hollow cylindrical interior which is open at first and second ends 6, 8. The cylindrical cartridge 4 is provided with a plurality of axial slots, two of which are referenced at 10, 12 and it is by means of such slots that exterior surfaces of the absorbent wick are exposed to the liquid nicotine-containing formulation which the cartomizer is adapted to receive prior to use. Screw threaded portions 14, 16 are provided at either end of the cartridge which facilitate secure connections to, on the one hand, an air flow regulator component 20 and on the other hand a mouthpiece and liquid charging assembly 22. Air flow regulator 20 and mouthpiece assembly are provided with corresponding threaded portions, and a plurality of rubber or other suitable material O-ring seals are provided (not shown) as required to ensure that the connection between screw-threaded connection between these parts is essentially sealed and fluid-impregnable. The cartomizer assembly further includes a clear plastics material cylindrical out sleeve 30 which, during assembly, is clamped between air flow regulator 20 and mouthpiece assembly 22, and again, appropriately sized and positioned O-ring seals (not shown) are provided to ensure that reliable fluid impregnable seals are created between both annular ends 32, 34 of the sleeve and the air flow regulator 20 and the mouthpiece assembly 22 respectively. Thus, when completely assembled, two separate, sealed chambers are defined within the cartomizer 2, the first consisting essentially of the cylindrical hollow interior of the cylindrical cartridge 4, and the second being the generally annular cavity defined between said cartridge and the interior surface of the cylindrical sleeve 30 and it is into this annular cavity that the nicotine-containing liquid is deposited prior to use through the mouthpiece and charging assembly 30 through an appropriate charging slot (not shown) provided in assembly 22.

Although not shown in the Figure, the wick and coil arrangement itself is also essentially cylindrical and comprises an annular layer of an absorbent material such as cotton or some organic or inorganic synthetic equivalent material which forms the wick, and a simple electrical coil is disposed directly adjacent the interior cylindrical surface of the wick layer with the various windings thereof extending axially from one end of the wick layer to the other. As briefly mentioned above, in order that the aerosolizable liquid may soak into the wick, a plurality of slots 10, 12 are provided so that portions of the wick layer are exposed thereby, and liquid contained within the annular cavity surrounding the wick and coil arrangement is in direct contact with said exposed wick layer portions which thus absorb and become soaked with the said liquid beneath the level of said liquid. As the name suggests, the wicking nature of the absorbent material wick encourages the flow of liquid within the wick from the soaked regions to other regions not ordinarily submerged in liquid, and while the distribution of liquid throughout the wick is far from uniform, in general the wicking effect is sufficient to ensure that the majority of the wick is at least moist if not entirely soaked with the aerosolizable nicotine-containing liquid formulation.

There are further aspects of prior art cartomizers which deserve mention. Firstly, the coil of the wick and coil assembly must of course be electrically connected to the battery, and such electrical connection is most commonly achieved by means of a simple two-pole screw thread connection indicated generally at 40 provided on a distal closed end of the air flow regulator. For example, the screw thread connection may comprise firstly an exterior screw thread by means of which an electrical connection is achieved to one pole of the battery, and secondly an interior spigot or pin by which electrical connection is achieved to the second pole of the battery. Thus, as the cartomizer is threadedly connected to the battery, reliable and robust electric and mechanical connections therebetween are automatically achieved. Within the interior of the cartomizer assembly, suitable electrical and mechanical connections between the cartomizer itself and the wick and coil assembly may also be similarly achieved with one end of the coil assembly being in electrical communication with the exterior body of the wick and coil assembly and the other end being in electrical communication with an interior end cap, end plug or other suitable component of the assembly being of course appropriately electrically isolated from the exterior body thereof. Regardless of the manner in which the electrical connection between battery and wick and coil assembly is achieved, it is generally desirable that there is some segregation within the cartomizer between the liquid within the cartomizer and the coil such that the coil is not entirely or even partially submerged in liquid, and that the heating action of said coil is thus directed predominantly on the wick and the liquid absorbed therein. As will be understood from the above, the various O-ring seals provided as part of the cartomizer assembly ensure that the annular liquid-containing cavity to the exterior of the wick and coil assembly is effectively isolated from its hollow interior in which the coil is disposed. One of the fundamental reasons behind such isolation relates to the required airflow which is to occur within the cartomizer assembly when the ENDS is active and heat from the coil is causing aerosolization of the absorbed liquid in the wick.

To explain further, modern cartomizers such as that illustrated in FIG. 1 provide not only a confined chamber in which aerosolization of a nicotine-containing liquid can occur (this chamber most commonly being the interior of the wick and coil assembly), but also air inlet and outlet regions between which air can be caused to flow along a predefined path into, through and out of the cartomizer assembly during each and every user inhalation. Thus, referring again to FIG. 1, the cartomizer assembly includes a mouthpiece component 26 consisting of a short hollow plastic tube or plug which is sealingly inserted into, or which forms an integral part of the mouthpiece assembly 22.

For most prior art ENDS, the mouthpiece component is nothing more than a simple hollow tube which merely functions as an extension of the cartomizer assembly and which is in communication with the interior aerosolization chamber through a suitable aperture (not shown) provided in the mouthpiece assembly, and also as a means around which a user can purse his lips easily and quickly prior to and during an inhalation. At the opposite end of the cartomizer assembly, the air flow regulator 20 includes an adjustable regulator indicated generally at 23 by means of which the circumferential dimension of slot 23A can be enlarged or reduced, in the latter case to a zero, in which case ambient atmosphere is largely precluded from entering the cartomizer assembly with the result that the resistance to suction applied at the mouthpiece as hereinafter described will be very high. Of course, air flow regulator 20 can be adjusted to according to user preference.

In use, a negative pressure differential relative to the ambient air pressure is applied at the free, open end of the mouthpiece component, and this may be a achieved by a user either by performing a single "tidal" breathing action, or (more commonly, especially for smokers) or by a two-step process involving firstly a buccal cavity expansion whereby the user exerts a suction pressure in their mouth, followed by separate inhalation of the aerosol drawn into the mouth from the activated cartomizer as a result of that suction and after the ENDS has been removed from the mouth. Regardless of how the negative pressure differential between the effective air inlet and outlet regions of the cartomizer is applied, the result is that ambient air is caused to flow into the cartomizer assembly through slot 23A, whence it travels into the base of the air flow regulator assembly 20 and upwardly into and through the innermost cylindrical aerosolization chamber inside the cartridge 4, thus entraining any aerosolised nicotine-containing formulation contemporaneously extant therein. From there, aerosol-rich air then passes out of the cartridge 4 through mouthpiece component thereof into the mouth of the user. Importantly, especially in the context of the present invention, airflow within the cartomizer is constrained to flow exclusively through the interior aerosolization chamber regardless of the particular location or configuration of the cartomizer air inlet(s), and is specifically prevented from escaping into the annular liquid-containing chamber which exteriorly surrounds it by means of the various O-ring seals and the sealing effect they provide. Indeed, and regardless of the particular airflow paths within the cartomizer, if the annular liquid-containing cavity were not appropriately sealed, liquid therein could easily leak from the cartomizer with self-evident consequences.

Thus it can be understood that the air flow through the cartomizer assembly is singular and direct—that is there is only a single air flow path, air flows directly from the inlet to the outlet of the mouthpiece, and all air flows through the innermost aerosolization chamber. In early ENDS, the only regulation of airflows was provided by the size of the inlet and/or outlet apertures which, being typically of the order of 1-2 mm diameter, provided a slight resistance to airflow similar to that experienced by smokers of conventional tobacco products when sucking air and the various products of tobacco combustion through them. In more recent ENDS, such as those available from manufacturers such as:

- Shenzhen IVPS Technology Co. Ltd. (who manufacture devices currently sold under the "SMOK"® trademark),
- Shenzhen Innokin Technology Co. Ltd. (who manufacture devices currently sold under the "INNOKIN"® and "iTaste"® trademarks), and
- The inventor "Tiu Langfang", director of Shenzhen Eigate Technology Co. Ltd.

(who manufacture devices currently available under the "ASPIRE"® trademark), dedicated adjustable airflow regulators are provided, as described above. In some devices, the opening can be completely eliminated or closed thus effectively closing the air inlet—in such condition, very little air (i.e. only that flowing through interstices arising from manufacturing tolerances) is capable of being drawing into the device with the result that the suction resistance is very high.

Again, however, although such regulators provide ENDS with operative flexibility, air is still strictly constrained to flow within the cartomizer solely from the inlet, regulated or not, thence directly into the aerosilation chamber, and finally from there through the outlet and into the mouthpiece before finally exiting into a user's mouth, and flow is possible regardless of whether the device is activated, i.e. when electric current is supplied to the heating coil and aerosolization of liquid in the soaked wick is occurring, or not.

The present invention adopts a very different approach and seeks to provide a different type of ENDS wherein an essentially disposable substrate component is pre-dosed with a relatively much smaller amount of a nicotine-containing formulation, and being equivalent to that which a smoker of a conventional tobacco product, in particular a cigarette, might be expected to consume during the smoking of a single such cigarette. Ideally, the formulation will be a viscous liquid, a gel, or a solid which can be liquefied by application of heat, or indeed a material having the physical characteristic that it does not tend to flow over the surface of the substrate to any great extent, whether being aerosolised or not. Thus, where it is relatively straightforward to mix large batches of base liquids (e.g. glycerols, polyethylene glycol (PEG), vegetable glycerol (VG), and/or propylene glycol (PG)) with liquid nicotine to manufacture a conventional e-liquid with the desired nicotine concentrations (e.g. 6-20 mg/ml), it is far less straightforward to dose a disposable substrate with an amount (typically volumetrically at least one, if not two or three orders of magnitude less) of an aerosolizable nicotine-containing formulation, and wherein the nicotine concentration within the particular dose is both much greater per unit of carrier compound, and is thus very much more precisely controlled.

Figure 2:
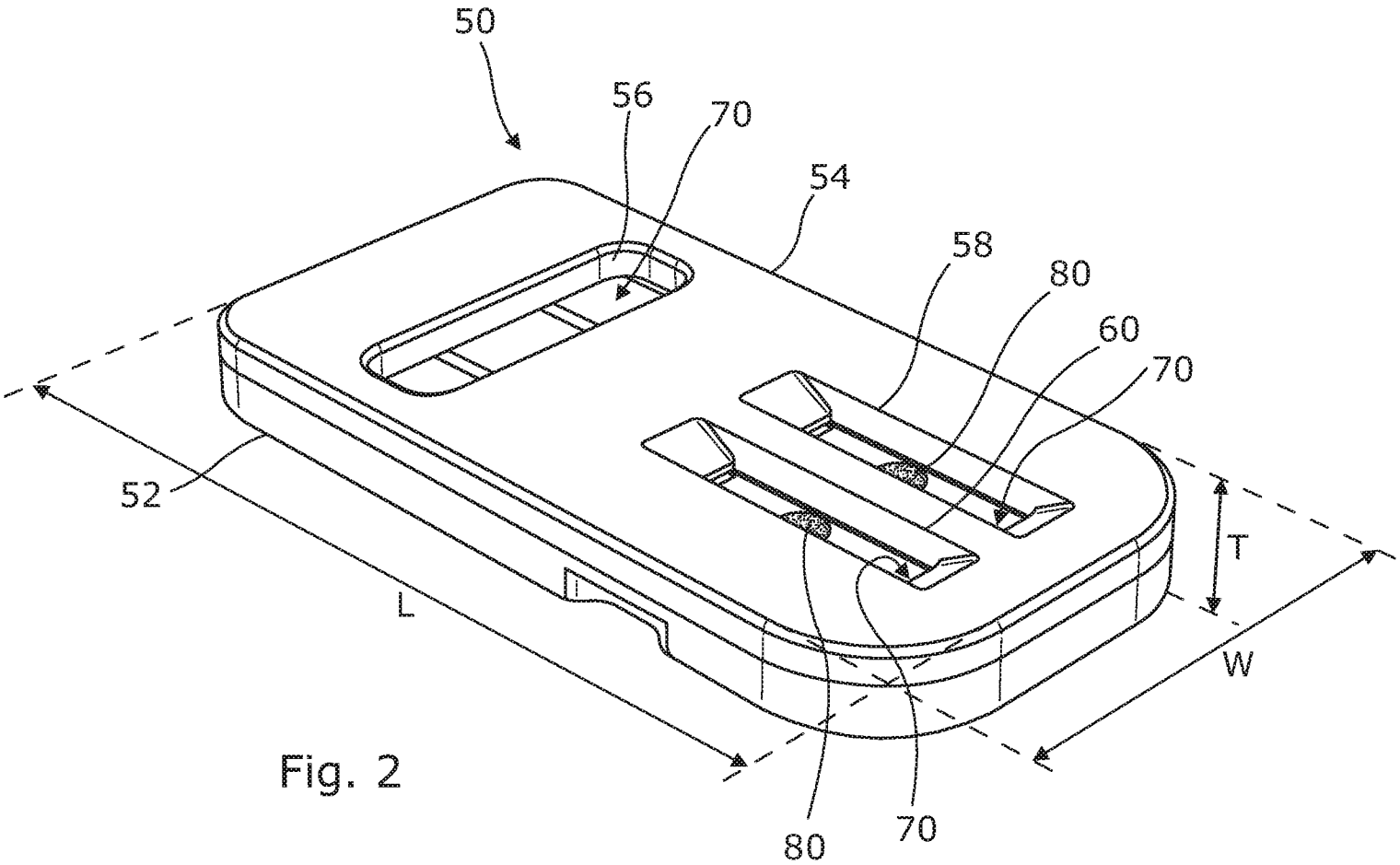
FIG. 2 shows a perspective view of a substrate component according to one aspect of the present invention.

Notwithstanding such manufacturing difficulties, Applicants herefor have devised an essentially disposable, and thus replaceable substrate component 50, one particular embodiment of which is depicted in FIG. 2. Said substrate component 50 consists of a base 52 and a cover 54 preferably both of a rigid plastics material and being firmly secured to one another such that one cannot be separated from the other without essentially destroying said substrate component. The dimensions of said substrate component, being length L, width W, and thickness T, may be in the region of 20-30 mm, 10-15 mm and 3-7 mm respectively. As shown in the Figure, cover 54 may be provided with a first lateral slot 56 and a pair of longitudinal slots 58, 60, all of which expose respective areas of a substrate 70 sandwiched within the substrate component and between said base and said cover, as more clearly seen in FIG. 3. Specifically referring to FIG. 3, lateral slot 56 is disposed towards a first (rear) end of the substrate component and exposes a corresponding area of the substrate 70. In this area, contact portions, one of which is referenced at 72, of an electrically resistive heating element 74 can be seen, such having been applied to an upper surface of the substrate 70, for example by screen-printing or otherwise. Contact portions 72 and resistive heating element will ideally be of the order of only 10 s or 100 s of microns thick. Thus, said contact portions will be exposed and accessible through the lateral slot 56, and an electrical connection therewith may be achieved through said lateral slot by means of a pair of appropriately sized electrical contacts or terminals (in general, the substrate will be provided with at least a pair of such contact portions 72, laterally spaced apart, and as may be required to complete an electrical circuit with the resistive heating element 74). Also, in FIG. 3, base 52 is provided with an appropriately sized rebate 62 (which may be of course be alternatively or similarly provided on the underside of the cover 54) which can accept the substrate 70 and which may be resiliently or fixedly retained therein and thereby.

As regards to the longitudinally orientated slots 58, 60 provided in the cover 54, such coincide with and thus selectively expose areas of the resistive heating element 74 such that a pair of globules 80 (see also FIG. 3) of a suitable amount of a nicotine-containing formulation and having been previously applied to and/or deposited on the upper surface of said substrate in appropriate locations over said resistive heating element are substantially contained within the longitudinally orientated slots 58, 60 when the substrate component is assembled. Of course, it will be understood that the application of such globules may occur after assembly of the substrate component, but in any event, it is important in the context of the present invention that whatever amount of said formulation, and in whatever form, is substantially contained within the said slots such that when the resistive heating element is appropriately energised, and thus heated, a sufficient amount of heat can be transferred directly to said globules of formulation and aerosolization thereof can commence, and that the aerosol thus produced is promoted directly into the air at that time extant within the slots 58, 60 immediately above said globules.

Figure 3:
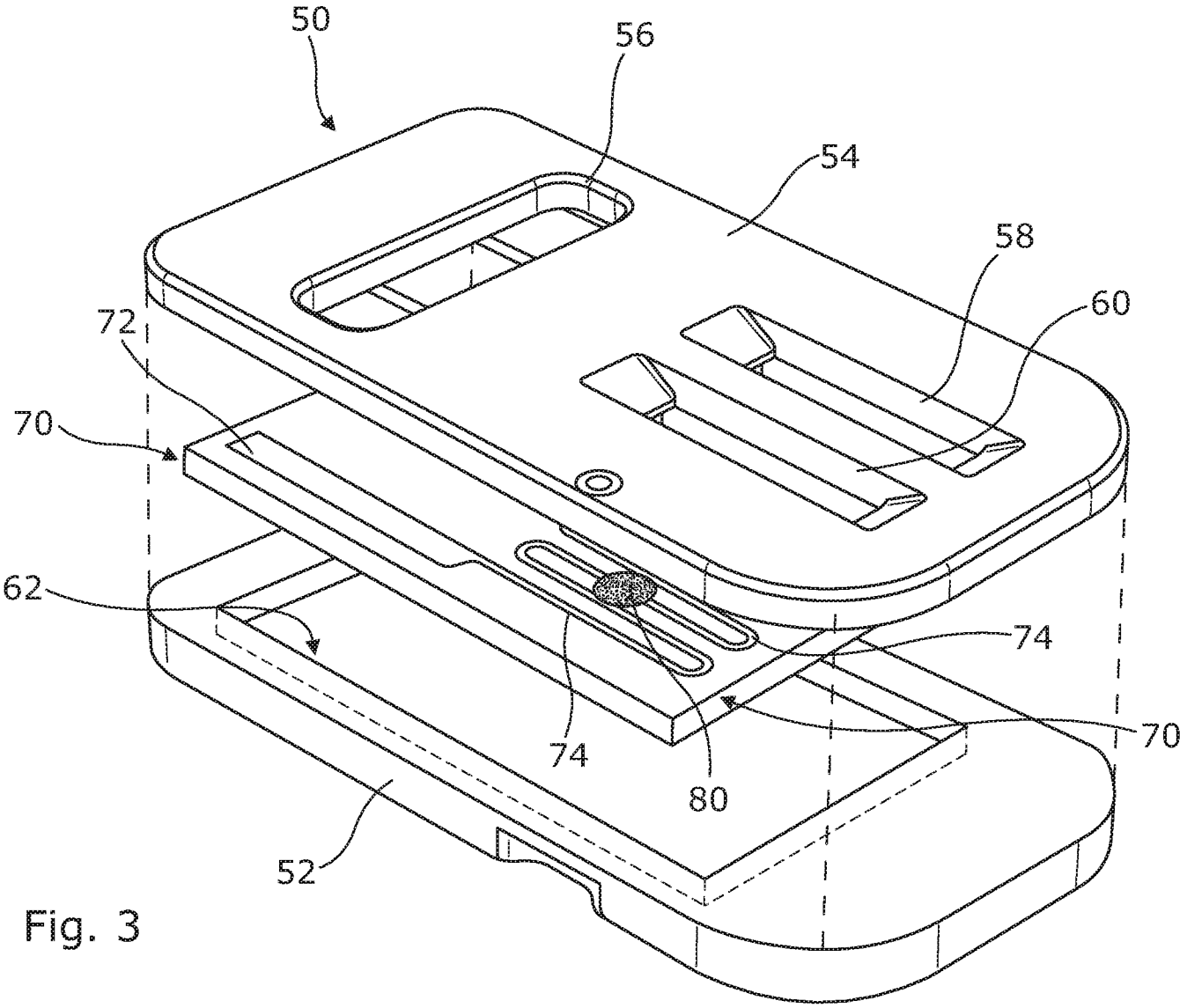
FIG. 3 shows an exploded perspective view of the substrate component of FIG. 2.
Figure 4:
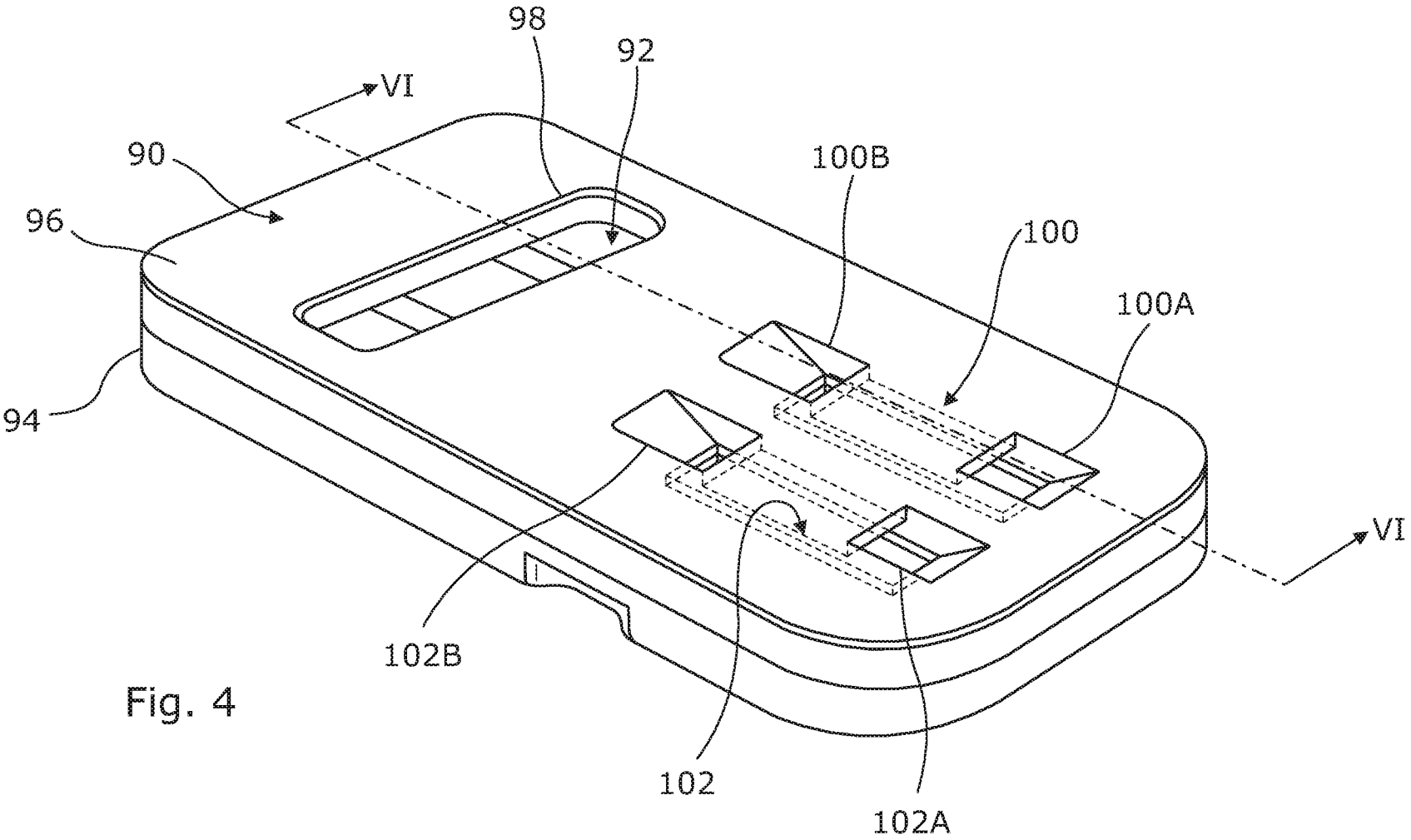
FIG. 4 shows a perspective view of a substrate component according to a modified aspect of the present invention.

An alternative embodiment of the substrate component of FIGS. 2 and 3 is shown in FIG. 4, wherein a substrate component indicated generally at 90 is of generally similar construction in that a substrate 92 is sandwiched between a base 94 and a cover 96 in which a rearward lateral slot 98 is provided for exactly the same purpose as slot 56 of substrate component 50 described above, but in this case, a pair of longitudinally orientated channels, shown in dotted line and referenced generally at 100, 102, is provided on the underside of the cover 96, each of said channels opening into the upper surface of the cover, at their forwardmost and rearmost ends, in a respective pair of apertures 100A, 100B and 102A, 102B respectively. Thus, in this particular embodiment of the (completely assembled) substrate component, the upper surface of internally and fixedly mounted substrate and said interior channels provided on the underside of the cover 96 together cooperate to define a pair of interior conduits within the substrate component whereby air drawn into apertures 100B, 102B is capable of flowing internally within the substrate component along said conduits before ultimately emerging therefrom through apertures 100A, 100B respectively, and as will hereinafter be more fully described.

Figure 5:
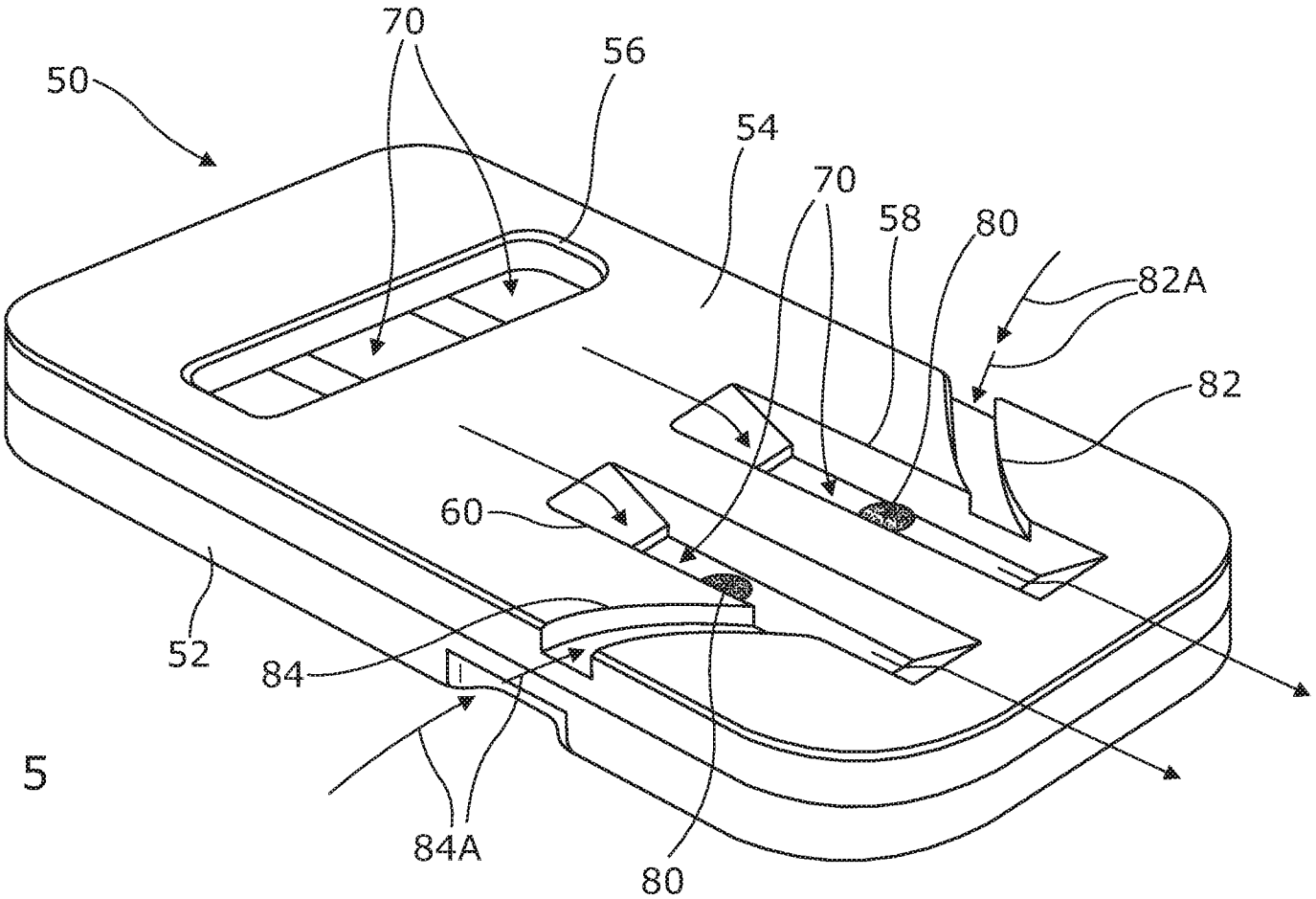
FIG. 5 shows a perspective view of a substrate component of a yet further modified aspect of the present invention.

In a yet further modified embodiment of the substrate component of FIGS. 2 and 3, illustrated in FIG. 5 in which appropriate reference numerals have been retained, the cover 54 may be additionally provided with a pair of lateral inlet air flow channels 82, 84 by means of which secondary air flows into channels 58, 60 can be established (air flowing within the channels 58, 60 from front to rear being considered primary) as indicated at 82A, 84A respectively. The source of such air will, like that for the primary air flows, will generally be the same, i.e. ambient atmosphere, but the fact that there is some lateral component of velocity of such air will inevitably aid to the mixing of the primary and secondary air flows. It is to be noted from the Figure that the channels 82, 84 both emerge into the channels 58, 60 at a location downstream of the globules 80 of the formulation which may be being aerosolised. Although this is the most preferred arrangement, in alternative embodiments, channels 82, 84 may emerge into channels 58, 60 at a location substantially coincident with that at which the globules of formations are deposited on the substrate, or yet further alternatively, the point of emergence of channels 82, 84 may be upstream of the location of said globules on the substrate 70 and contained within channels 58, 60. Furthermore, and in accordance with certain embodiments of the invention, any one or more of the channels 58, 60, 82, 84 may be provided with one or more baffle formations to further aid mixing of both primary and secondary fluid flows at any time occurring within said channels, and which may induce some degree of randomness or even turbulence of the flows occurring therein. The skilled reader is to understand that the features above described in relation to FIG. 5 apply equally to the substrate component 90 of FIG. 4, and in particular baffle formations may be provided on the underside of the cover 96 in the channel formations 100, 102 provided therein, and additionally, one or more further lateral channel formations may be provided and cooperate with both the base 94 and the substrate 92 to define conduits having lateral entrances and by means of which it may be possible to establish secondary at least partially laterally directed airflows interiorly of the substrate component 90, said secondary airflows ultimately being delivered to and mixing with the primary air flows occurring at any time within the conduits defined between the substrate component and the said channels 100, 102.

Figure 6:
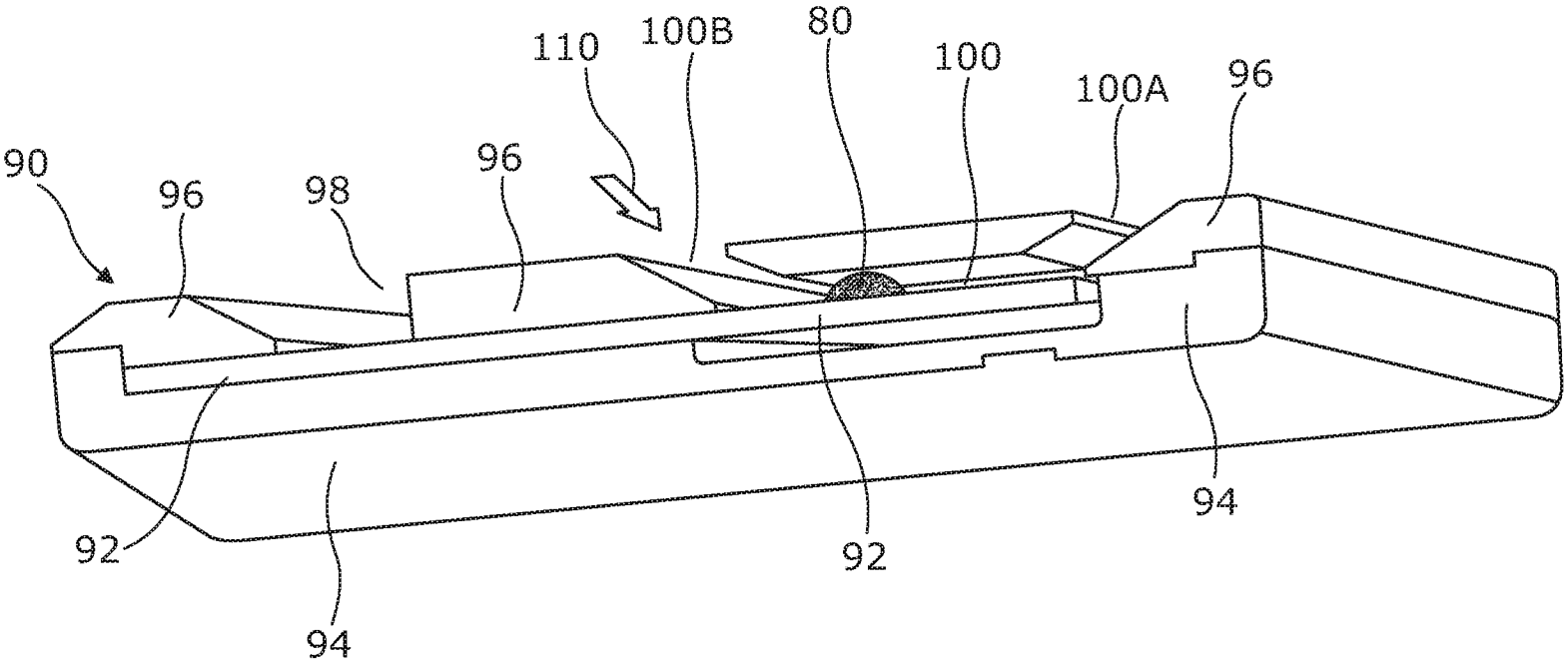
FIG. 6 shows a sectional perspective view of the substrate component of FIG. 4 taken along section VI of that Figure.

Referring now to FIG. 6, there is shown a sectional perspective view of the substrate component 90 of FIG. 4 and in which it can be more clearly seen how the substrate 92, base 94 and cover 96 cooperate with one another in the assembled substrate component, and in particular how an interior conduit is defined internally within the substrate component as a result of the cooperation of an upper surface of the substrate 92 and an underside of the cover 96 where the channel formations 100, and respective exit and entry openings or apertures 100A, 100B respectively thereof are provided. Additionally, a globule of aerosolization formation 80 is shown having been previously deposited on an upper surface of the substrate 92, and it will be immediately appreciated by the skilled reader that air caused to flow into said conduit through aperture 100B as shown by arrow 110 at a time when the substrate is being supplied with source of electrical energy such that the resistive heating element applied to the upper surface thereof has become hot and is causing at least some aerosolization of the formulation, and thus the nicotine within it, will entrain any aerosol produced as it passes over the globule within the said conduit, and thus that the fluid exiting through aperture 100A will be aerosol-laden air.

Figure 7:
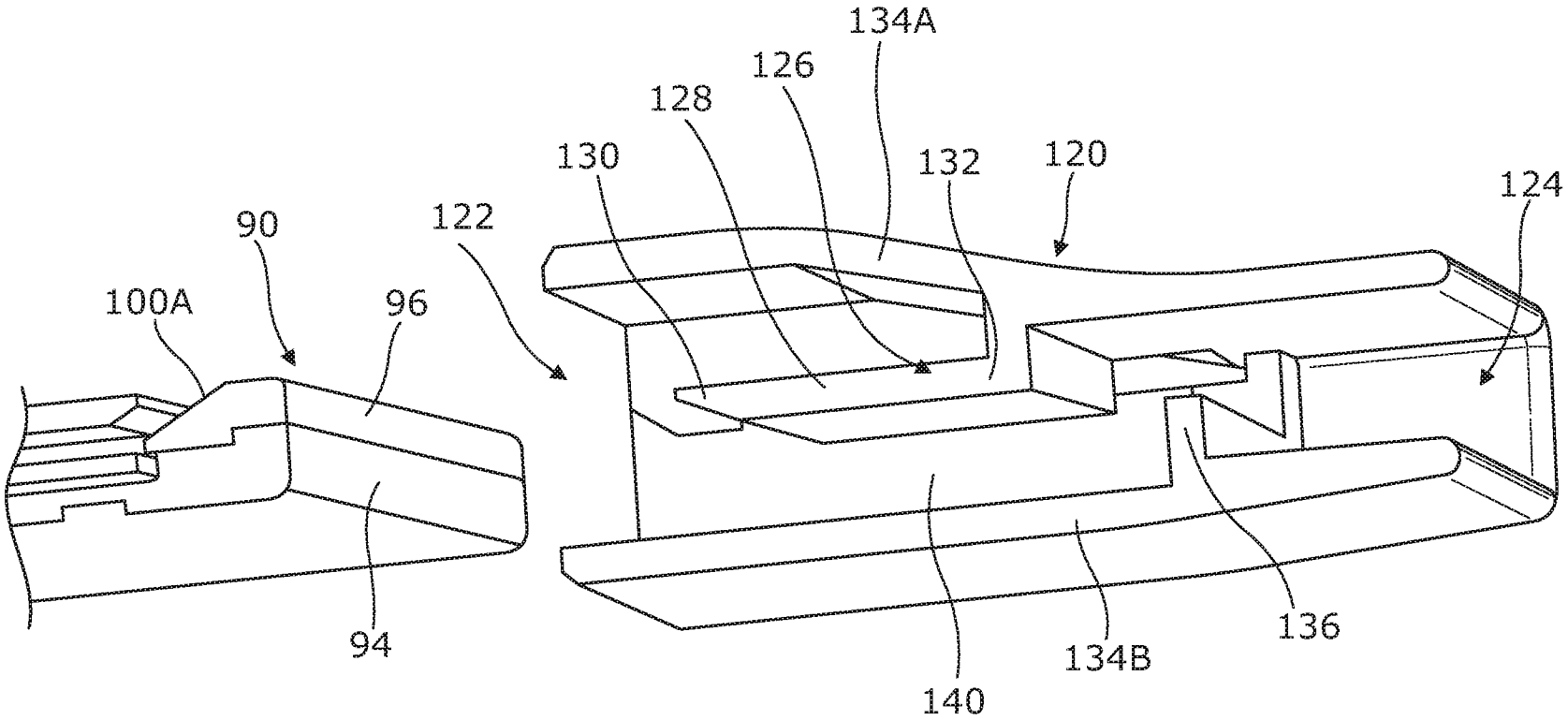
FIG. 7 shows a sectional perspective view of a part of the substrate of FIG. 4 prior to insertion into a mouthpiece.

Referring now to FIG. 7, the foremost end of substrate component 90 is shown prior to insertion into a mouthpiece component, both sectionally illustrated and said mouthpiece component being indicated generally at 120, which together complete at least one aspect of the mouthpiece assembly according to the present invention. As can be seen in the Figure, mouthpiece component 120 has an inlet end 122 and an outlet end 124 around which a user can easily purse his lips as part of, and immediately prior to an inhalation. Internally of said mouthpiece component, there is provided a cantilever formation indicated generally at 126 and comprising a cantilever 128 having a chamfered free end 130 rearwardly disposed of said mouthpiece component and a fixed end 132 which is rigidly secured to an inner surface of the rigid exterior 134A of said mouthpiece component. The lower surface of the cantilever 128, the interior upwardly facing surface of the lowermost portion 134B of the mouthpiece component rigid exterior, and an interior inwardly and upwardly projecting formation 136 together define a cavity 140, or at least most of the three surfaces thereof, whose depth is approximately the same as the thickness dimension of the substrate component it is adapted to receive. In some embodiments, the cantilever 128 may be biased slightly downwardly so that it is resiliently deflected upwardly as the substrate component is slid into the mouthpiece component, and so that the former is resiliently secured by the latter, axially by means of frictional engagement between the upper surface of the substrate component, and vertically by means of the reaction against the downwardly directed force of the cantilever in its slightly deflected state.

Figure 8:
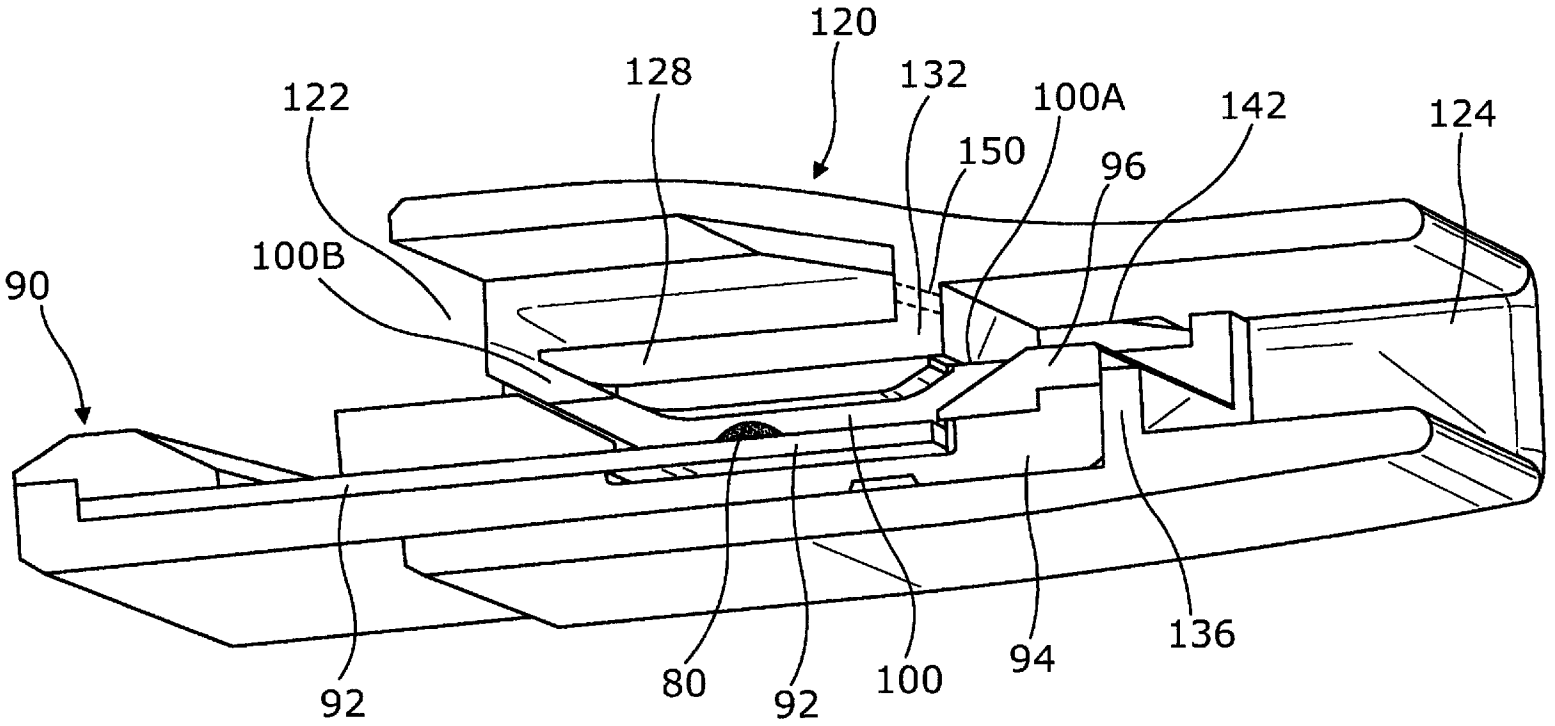
FIG. 8 shows a sectional perspective view of a mouthpiece assembly according one aspect of the present invention and including both mouthpiece and the substrate component of FIG. 4 therewithin.

Referring now to FIG. 8, the mouthpiece assembly 90, 120 is shown in its completely assembled state, in which the substrate component 90 is shown completely inserted into and within the mouthpiece component 120. In this Figure, it can be seen that the foremost end of the substrate component 90 abuts the upwardly projecting formation provided inside the mouthpiece component 120 which thus defines the maximum extent of axial travel of the said substrate component within the mouthpiece component. Furthermore, the upwardly projecting formation is provided at an axial position along the length of the mouthpiece component such that

- the exit aperture 100A formed within the upper surface of cover 96 is (mostly) disposed axially forwardly of the rigidly fixed end 132 of the cantilever 128 such that any airflow occurring within the aforementioned conduit defined interiorly of said substrate component exits into a pre-exit chamber 142 of defined within the mouthpiece component immediately upstream of the outlet 124 thereof,
- that the lower surface of said cantilever frictionally engages with the upper surface of the cover 96 of said substrate component, such frictional engagement effectively securing said substrate component within the mouthpiece component, and
- the rearmost aperture 100B provided in the upper surface of the cover 96 of the substrate component 90 is at least partially disposed anteriorly of the lower surface of the cantilever 128, and furthermore (in a particularly preferred embodiment) cooperates with the chamfered free end 130 thereof to define an air inlet passageway such that air entering the inlet 122 of the mouthpiece component is directed internally thereof towards and into the aperture 100B, and thus in turn through the conduit 100 defined internally of the substrate component between the cover 96 and the substrate 92 and thus over the globule 80 of formulation provided on the upper surface of said substrate.

Naturally, all of the above applies equally for the other set of apertures 102A, 102B provided in the cover 96 of the substrate component, but not specifically illustrated in this Figure.

In one particularly preferred embodiment, one or more fluid bypass apertures, one of which is generally indicated at 150 in FIG. 8, may be provided such that air being drawn into the mouthpiece component 120 through inlet 122 may not only mostly or partially be directed towards and into the conduit 100, but some portion of that air may be permitted to flow along a secondary pathway directly through said bypass aperture(s) through the mouthpiece component without necessarily flowing through the said conduit. In such case, an amount of bypass air will be mixed with the primary air flow which, if the device is activated and aerosol is being produced within the substrate component, will be laden with aerosol, and depending on the number and size of the bypass apertures, such mixing, and the fact that relatively less air will be laden with aerosol during activation, may increase the tolerability of the resulting volume of fluid which is ultimately inhaled by a user.

In a yet further alternative embodiment, the mouthpiece component may additionally or separately be provided with secondary lateral air inlets (not shown) in one or more of the side walls thereof, the axial disposition and size of such secondary lateral inlet apertures being chosen such that on complete insertion of the substrate component, there is at least partial registration between the said secondary lateral inlet apertures and one or both of the entrances of the secondary channels provided in the cover 96 (or possibly the base 94) of the modified substrate component 50 shown in FIG. 5.

It is also to be understood by the skilled reader that the substrate component 90 shown in FIGS. 7 and 8 (and also FIG. 9 described below) is that possessing interiorly defined conduits 100, 102. In the case where the substrate component 50, in which channels 58, 60 are provided, is employed, the upper surface of the cover 54 and the lower surface of the cantilever 128 provided within the mouthpiece component would cooperate to define similar conduits to conduits 100, 102, the only difference being that instead of substrate 92 providing one defining surface of such conduits, the lower surface of the cantilever 128 would perform that function.

Figure 9:
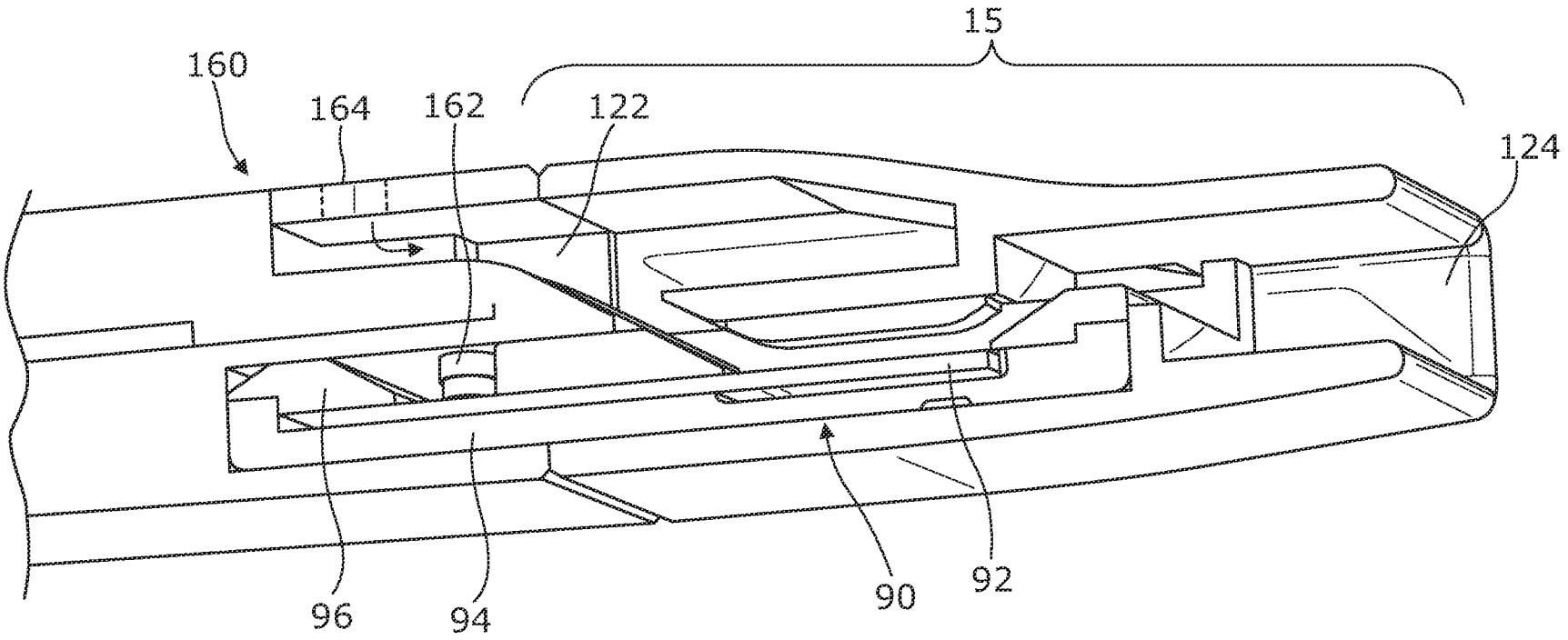
FIG. 9 shows a sectional perspective view of a ENDS including the mouthpiece assembly of FIG. 8.

Referring finally to FIG. 9, the complete mouthpiece assembly 15 is shown connected to the free end of a body 160, which, although not shown, will contain an elongate battery and be provided with an activation switch of suitable form whereby a user can cause electrical energy from the battery to be supplied to the resistive heating element (not shown, but see FIG. 3, ref. 74) on the upper surface of the substrate, 70, 92. In FIG. 9, one of a pair (or possibly a triplet, quartet, quintet or some other suitable multiple) of electrical contacts, one being illustrated at 162, is suitably configured and axially disposed within the body 160 proximate the free end thereof such that on connection of the mouthpiece assembly 150 to the body (ideally by a push-fit type connection), said contacts (being, for example, the common spring-loaded pogo-pin type) may be initially deflected vertically upwardly against their spring bias by the chamfered rearmost end of the cover 96 of the substrate component, and after said chamfered rearmost end of the cover 96, and thus the substrate component, has travelled sufficiently within the body, the spring loaded contacts are received within the lateral slot 98 (or 56), the springs within the electrical contact(s) 162 recover, the result being that the contacts are both correctly laterally and axially disposed within said slot and are biased into firm electrical contact against the exposed surface of the appropriate contact portions of the electrical resistive heating element. Once in this condition, not only is the mouthpiece assembly 150 firmly and electrically connected to the body 160, and thus now capable of being activated, i.e. electrical energy can be reliably supplied to the substrate component, but also the air inlet 122 of the mouthpiece assembly is simultaneously brought into registration with, ideally in sealing fashion, a corresponding air outlet of the body, which is itself provided with a suitable air inlet 164, and at least one complete fluid pathway from inlet 164 to mouthpiece outlet 124 is established, at least some portion of which is directly adjacent and immediately above the upper surface of the substrate 92 contained within the substrate component 90.

The invention claimed is:

1. A mouthpiece assembly for an inhalation device, said mouthpiece assembly comprising: a mouthpiece and a substrate component;

said mouthpiece having a first air inlet disposed proximate a first end thereof, and an air outlet disposed proximate a second end thereof axially remote from said first end, said first air inlet and said air outlet being in fluid communication with one another within an interior of said mouthpiece such that fluid flow within said mouthpiece tends to occur along a substantially longitudinal axis thereof, said mouthpiece having a cavity region defined internally thereof and which receives and locates the substrate component within said mouthpiece such that said substrate component interacts with said fluid flow when occurring;

said substrate component comprising a cover including a first substantially planar surface in which at least one elongated longitudinal slot is provided, and a planar substrate fixedly mounted underneath the cover and having a substrate region to which has been applied an electrically resistive heater element, wherein said at least one elongated longitudinal slot at least partially coincides with said substrate region so as to expose said substrate region;

wherein said cavity region is at least partially defined by a plurality of formations provided in the interior of said mouthpiece, at least one of said formations at least partially defining an end wall of said cavity region against which one end of said substrate component abuts when completely received with said cavity region; and wherein when the substrate component is completely received in the cavity region, said first substantially planar surface of said cover cooperates with a corresponding interior surface of said cavity region such that together said at least one elongated longitudinal slot, said corresponding interior surface of said cavity region, and that part of said substrate region which is exposed by said elongated longitudinal slot define at least one conduit interiorly of said substrate component, such that all fluid flow occurring within the mouthpiece enters said at least one conduit before exiting the mouthpiece assembly.

2. The mouthpiece assembly according to claim 1, wherein the substrate component is elongated, and the at least one elongated longitudinal slot is aligned substantially parallel with a longitudinal axis of the substrate component.

3. The mouthpiece assembly according to claim 1, wherein the substrate component is provided with two elongated longitudinal slots being linear and parallel in configuration and orientation.

4. The mouthpiece assembly according to claim 1, wherein the mouthpiece is provided interiorly with at least one secondary conduit which acts as a fluid bypass in that an initially unitary fluid flow entering the mouthpiece through the first air inlet thereof is divided into in at least two discrete parts, the at least two discrete parts comprising a first active part which is constrained to flow into and through the at least one conduit defined interiorly of the substrate component, and a second bypass part which is separate and distinct from the first active part and segregated from it for a majority of travel within the mouthpiece.

5. The mouthpiece assembly according to claim 4, wherein the first active part and the second bypass part of the initially unitary fluid flow entering the mouthpiece are reunited within the mouthpiece in a dedicated mixing chamber thereof.

6. The mouthpiece assembly according to claim 5, wherein the first active part and second bypass part of the fluid flow within the mouthpiece are reunited within the mouthpiece in a dedicated mixing chamber defined interiorly within said mouthpiece which is downstream of the substrate component but upstream of the mouthpiece air outlet.

7. The mouthpiece assembly according to claim 1, wherein the mouthpiece is provided with one or more interior baffle formations.

8. The mouthpiece assembly according to claim 1, wherein one or more baffle formations are provided in the at least one conduit.

9. The mouthpiece assembly according to claim 1, wherein the mouthpiece is provided with at least one secondary air inlet, said at least one secondary air inlet being in a form of an aperture provided through and disposed in one of: a side wall, a top wall and bottom wall of said mouthpiece, said aperture being disposed between said first air inlet and said air outlet and being in fluid communication with both, wherein an interior surface of said side wall, top wall or bottom wall forms one of those surfaces which constrains fluid flow interiorly and longitudinally axially of the mouthpiece such that initial direction of travel of air entering said each aperture is substantially perpendicular to a direction of fluid flow within the mouthpiece from the first air inlet to the air outlet.

10. The mouthpiece assembly according to claim 9, wherein each aperture forming the secondary inlet is located at one of: more proximate to the first air inlet than to the air outlet of the mouthpiece, and more proximate to the air outlet than to the first air inlet of the mouthpiece.

11. The mouthpiece assembly according to claim 9, wherein the substrate component is provided with at least one secondary channel formation having an entrance which is separate from an entrance of the at least one elongated longitudinal slot, said at least one secondary channel formation being one of:

entirely separate from the at least one elongated longitudinal slot, in that said at least one secondary channel formation is provided with its own discrete and separate exits, and united with said at least one elongated longitudinal slot, in that said at least one secondary channel formation emerges into the at least one elongated longitudinal slot in a top, bottom or side wall thereof, such that there is a confluence of the fluid flows at any time occurring within each of the at least one elongated longitudinal slot and the at least one secondary channel formation.

12. The mouthpiece assembly according to claim 11, wherein the at least one elongated longitudinal slot and the at least one secondary channel formation are united, and the confluence of the fluid flows at any time occurring within the at least one elongated longitudinal slot and the at least one secondary channel formation occurs at a position axially of the substrate component which is one of: upstream of the substrate region, substantially coincidental with that substrate region, and downstream of that substrate region.

13. The mouthpiece assembly according to claim 11, wherein an entrance of the at least one secondary channel formation of the substrate component coincides with the at least one secondary fluid inlet aperture provided in the mouthpiece.

14. The mouthpiece assembly according to claim 13, wherein the at least one secondary channel formation provided in the substrate component is lateral in that the entrance of the said secondary channel formation is provided in a side, top or bottom wall of the substrate component such that, initially at least, the direction of the fluid flowing into the said at least one secondary channel formation is substantially perpendicular to the direction of the fluid flow in the at least one conduit partially defined by the at least one elongated longitudinal slot when such fluid flows are occurring.

15. The mouthpiece assembly according to claim 1, wherein one or more interior surfaces of said mouthpiece is provided with a plurality of formations which together at least partially define the cavity region adapted to receive the substrate component, at least one of said formations defining said cavity region being internally cantilevered within the mouthpiece and biased into said cavity region when no substrate component is present therein such that when a substrate component is inserted into said cavity region, it is resiliently retained therein as a result of the action of said cantilever.

16. The mouthpiece assembly according to claim 15, wherein a leading free end of the cantilevered formation is provided with a chamfered surface to aid insertion of a substrate component into the cavity region within the mouthpiece.

17. The mouthpiece assembly according to claim 1, wherein the cavity region of the mouthpiece comprises a first interior surface and a second interior surface, the distance therebetween defining a depth of the cavity region;

wherein the substrate component further comprises a base having a second substantially planar surface, the distance between the first and second substantially planar surfaces defining a thickness of the substrate component; and wherein the depth of the cavity region and the thickness of the substrate component are substantially the same.

* * * * *